United States Patent [19]

Bushnell

[11] 4,169,039

[45] Sep. 25, 1979

[54] RECOVERING USEFUL OIL FROM WAX FILTER HOT WASHINGS AND DUMPED SLURRY

[75] Inventor: James D. Bushnell, Berkeley Heights, N.J.

[73] Assignee: Exxon Research & Engineering Co., Florham Park, N.J.

[21] Appl. No.: 864,212

[22] Filed: Dec. 27, 1977

[51] Int. Cl.[2] ..... C10G 43/08

[52] U.S. Cl. ..... 208/33; 208/37; 208/38

[58] Field of Search ..... 208/33, 37, 38

[56] References Cited

U.S. PATENT DOCUMENTS

| | | | |
|---|---|---|---|
| 3,171,798 | 3/1965 | Woodle | 208/33 |
| 3,720,599 | 3/1973 | Gould | 208/33 |
| 3,764,517 | 10/1973 | Bodemuller | 208/33 |
| 3,773,650 | 11/1973 | Hislop et al. | 208/33 |
| 3,775,288 | 11/1973 | Eagen et al. | 208/33 |

*Primary Examiner*—C. Davis

*Attorney, Agent, or Firm*—Edward M. Corcoran

[57] ABSTRACT

In a DILCHILL* dewaxing process employing rotary drum wax filters, the waxy slurry in the filters must be periodically dumped and the filters washed with hot solvent to remove wax fines which plug the cloth. The dumped slurry contains useful oil which can be recovered, with no detriment to the subsequent filter rate, by mixing the dumped slurry with the hot filter washings and recycling this mixture back into the DILCHILL dewaxing zone at one or more points therein wherein the temperature of the recycled mixture is from about 5° to 50° F. lower than the bulk temperature of the oil in the dewaxing zone and in an amount ranging from about 0.02 to 0.4 volumes of recycle per volume of feed.

* DILCHILL is a registered service mark of the Exxon Research and Engineering Company.

7 Claims, 1 Drawing Figure

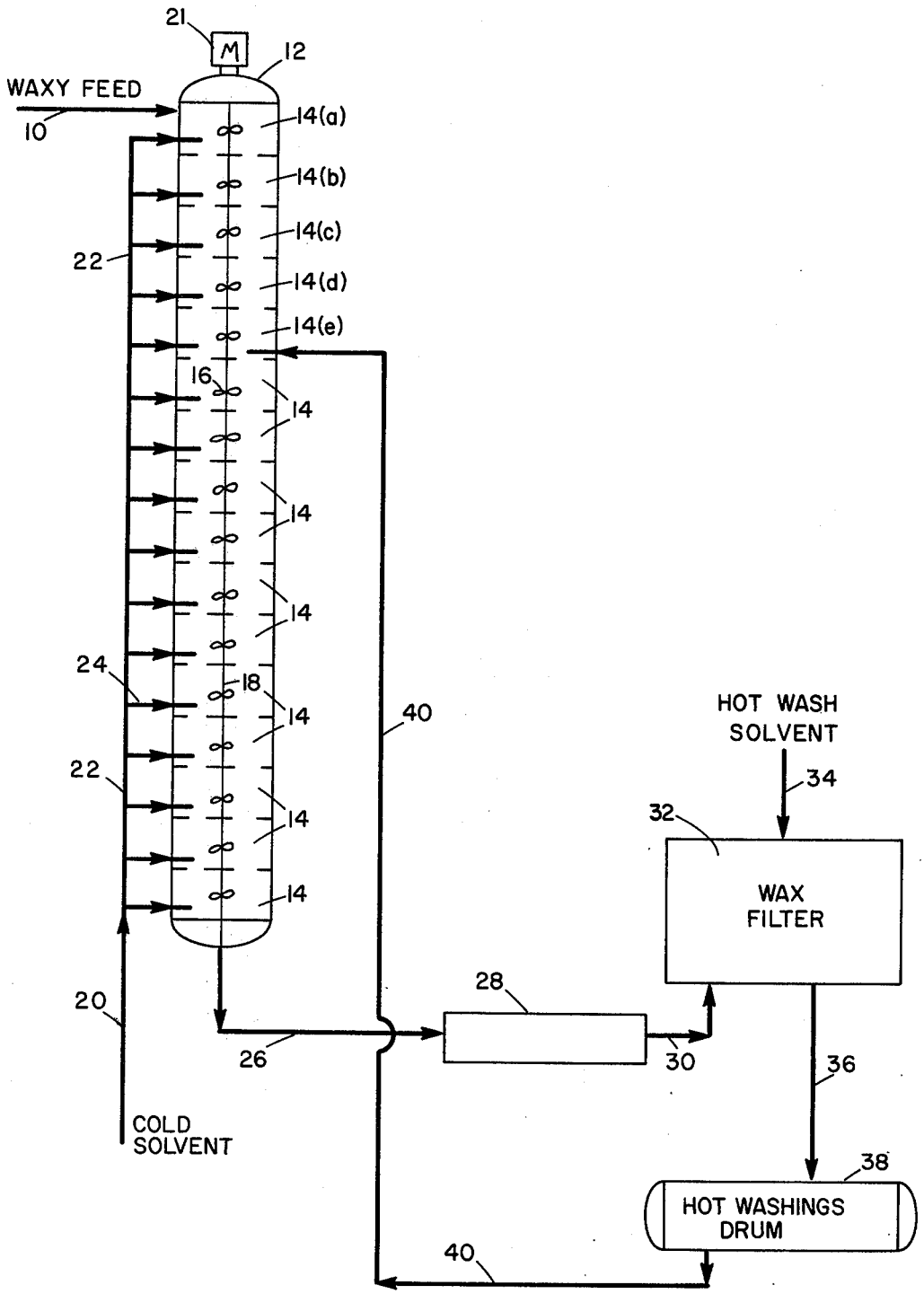
21
M
12
WAXY FEED
10
14(a)
14(b)
14(c)
14(d)
14(e)
22
16
14
14
14
24
18
14
40
22
14
14
HOT WASH
SOLVENT
34
32
WAX
FILTER
28
20
26
30
36
COLD
SOLVENT
38
HOT WASHINGS
DRUM
40

RECOVERING USEFUL OIL FROM WAX FILTER HOT WASHINGS AND DUMPED SLURRY

BACKGROUND OF THE INVENTION

1. Field of the Invention

This invention relates to a process for recovering useful oil from a waxy slurry dumped from a wax filter. More particularly, this relates to an improvement in a DILCHILL dewaxing process wherein waxy slurry containing useful lube oil is periodically dumped from the wax filters and the filter cloth is then washed with hot solvent, wherein the improvement comprises mixing the filter hot washings with the dumped slurry and recycling said mixture back into the DILCHILL dewaxing zone in an amount ranging from about 0.02 to 0.4 volumes of recycle per volume of the waxy feed and at a point therein wherein the temperature of the recycled mixture ranges from about 5° to about 50° F. below the bulk temperature of the oil in said dewaxing zone.

2. Description of the Prior Art

It is well known in the art to dewax wax-containing hydrocarbon oils, particularly the lube oil fractions of petroleum oil, in order to remove at least a portion of the wax therefrom to obtain a dewaxed oil of reduced cloud and pour points. This is done via the use of various solvent dewaxing processes in which the temperature of the wax-containing oil is lowered sufficiently to precipitate wax therefrom as solid crystals of wax. The presence of dewaxing solvent in the oil improves the fluidity and reduces the viscosity of the resulting slurry so that various filtration or centrifugation processes can be used to separate the wax from the dewaxed oil. Perhaps the best solvent dewaxing process in use today is the DILCHILL dewaxing process wherein a waxy oil feed is introduced into a staged chilling (wax crystallization) zone and passed from stage to stage of the zone, while at the same time cold dewaxing solvent is injected or introduced into a plurality of the stages therein and wherein a high degree of agitation is maintained in the stages so as to effect substantially instantaneous mixing of the waxy oil and solvent. As the waxy oil passes from stage to stage of the chilling zone, it is cooled to a temperature sufficiently low to precipitate wax therefrom without incurring the well known shock chilling effect. This process produces a wax/oil/solvent slurry wherein the wax particles have a unique crystal structure which provides superior filtering characteristics such as high filtration rates of the dewaxed oil from the wax and high dewaxed oil yields. This DILCHILL dewaxing process is disclosed in U.S. Pat. No. 3,773,650, the disclosures of which are incorporated herein by reference.

The waxy slurry produced in the DILCHILL dewaxing or wax crystallization zone is passed to scraped-surface chillers and then to continuous rotary drum filters in order to separate the solid wax particles from the dewaxed oil and solvent. Continuous rotary drum filters are well known and used in the petroleum industry for wax filtration and models specifically designed and constructed for filtering wax from fractions such as lube oil fractions are commercially available from manufacturers such as Dorr Oliver and Eimco. A typical rotary drum vacuum filter comprises a horizontal, cylindrical drum, rotatably mounted about its longitudinal axis, the lower portion of which is immersed in a vat containing the wax slurry, a filter surface comprising a cloth covering the horizontal surface of the drum, means for applying both vacuum and pressure thereto and means for both washing and removing wax cake deposited on the cloth as the drum continuously rotates around its horizontal axis. In these filters, the drum is divided into compartments or sections, each section being connected to a rotary (trunion) valve and then to a discharge head. The wax slurry is fed into the filter vat and as the drum rotates, the faces of the sections pass successively through the slurry. In a vacuum filter, a vacuum is applied to the sections as they pass through the slurry, thereby drawing oily filtrate through the filter medium and depositing wax thereon in the form of a cake. As the cake leaves the slurry, it contains oily filtrate which is removed therefrom by the continued application of vacuum, along with wash solvent which is evenly distributed or sprayed on the surface of the cake, thereby forming a solvent-rich wash filtrate. Finally, the wax cake is removed by a scraper which is assisted by means of blow gas applied to the interior of each section of the drum as it rotates and just before it reaches the scraper. In a pressure filter, the solvent contains an autorefrigerant, which, by virtue of its relatively high vapor pressure, is sufficient to apply a pressure differential across the filter surface of the drum, thereby eliminating the need for applying a vacuum thereto.

After a continuous rotary drum wax filter has been operating for a period of time which may vary from two hours to two days, the filter cloth starts to become clogged with very fine wax crystals which reduce the filtration rate. Therefore, it is necessary to periodically stop the filtering action, dump the slurry from the filter vat and apply hot solvent to the filter cloth for a few minutes in order to dissolve the fine wax crystals from the pores of the filter cloth. The filter vat is refilled with slurry and the filtration operation is then resumed. This dumped slurry contains useful dewaxed oil—sometimes amounting to one or two percent of the waxy oil feed going to the DILCHILL dewaxing or wax crystallization zone. It cannot be sent directly to dewaxed oil recovery, because the wax content is too high which would throw the dewaxed oil product off specification on cloud and pour points. The dumped slurry may be recovered as foots oil if there is a wax manufacturing operation, otherwise it goes into slack wax and typically ends up in fuel oil or as cat cracker feed. In any event, it is lost as dewaxed oil if disposed of in this manner.

In an attempt to avoid the loss of dewaxed oil, it has sometimes been the practice to inject the dumped slurry into the outlet of the DILCHILL wax crystallization zone upstream of the scraped surface chillers. Unfortunately, if this is done the partially dissolved wax crystals do not have a chance to grow to the proper size, because they are not exposed to the unique environment in the DILCHILL wax crystallization zone. This results in the presence of fine wax crystals in the wax filter feed which reduces the filtration rate thereby adversely affecting plant throughputs.

Alternatively, if one wishes to feed the dumped slurry at a significantly high rate into the entrance of the DILCHILL chilling zone, along with the waxy feed, it is necessary to heat the cold slurry up to about 130° F. or so in order to avoid shock chilling the feed. Not only does this result in loss of the potential chilling capacity of the dumped slurry, but it also requires additional heat and places additional load on the refrigeration system.

It would therefore be an improvement to the art if a way could be found to recover the useful dewaxed oil from the slurry that is periodically dumped from the filter vat, without adversely affecting either the filtration rate or the refrigeration load.

SUMMARY OF THE INVENTION

What has now been discovered is in a dewaxing process wherein a waxy hydrocarbon oil feed and solvent are introduced into a DILCHILL dewaxing or wax crystallizing zone to form a slurry comprising dewaxed oil, solvent and solid wax crystals and wherein said slurry is passed to a filter zone containing a filter surface for separating the solid wax from the dewaxed oil and solvent and wherein the slurry in said filter zone is periodically removed therefrom and mixed with solvent that was used to hot wash said filter surface, the improvement which comprises recycling from 0.02 to 0.4 volumes of said mixture of said slurry and said hot solvent filter washings back into said dewaxing or wax crystallizing zone per volume of oil feed entering said DILCHILL chilling zone, at one or more points in said zone wherein the temperature of said recycle mixture is from about 5° to 50° F. lower than the bulk temperature of the oil in said dewaxing zone at the point in which said mixture is injected thereinto. As hereinbefore stated under Description of the Prior Art, supra, the DILCHILL dewaxing or wax crystallizing zone must be the type disclosed in U.S. Pat. No. 3,773,650, wherein a waxy oil at a temperature above its cloud point is introduced into an elongated, staged DILCHILL chilling zone or wax crystallizer tower and cold dewaxing solvent is incrementally introduced into said DILCHILL chilling zone along a plurality of stages therein while maintaining a high degree of agitation in the solvent-containing stages so as to effect substantially instantaneous mixing of the solvent and wax/oil mixture as they progress through said zone. If the feed is a heavy petroleum oil fraction containing appreciable amounts (i.e., ≧, 10 wt.%) of residual materials (boiling above 1050° F.) such as a bright stock, it may be necessary to predilute the feed with a suitable solvent in order to reduce the viscosity of the feed to an acceptable level before it enters the DILCHILL chilling zone, in which case it will be introduced into said zone at a temperature above its depressed cloud point. The filter zone will comprise a continuous, rotary drum vacuum or pressure filter discussed under Description of the Prior Art, supra.

The hot solvent used to wash the fine particles of wax from the filter cloth after the slurry has been dumped from the filter vat will generally be at a temperature necessary to dissolve the wax crystals from the pores of the cloth within a period of a few minutes, and will contain the same solvent components, although not necessarily in the same proportion, as the solvent used to cool down the waxy oil in the DILCHILL crystallizing tower and precipitate the wax therefrom. On the other hand, the temperature must not be so high that a large portion of the wash solvent flashes to vapor as it enters the filter shell which is maintained close to atmospheric pressure. By way of example, when the solvent system is a mixture of MEK and toluene, the temperature of the hot solvent will range from about 140° to 180° F. Any solvent useful for dewaxing waxy petroleum oils may be used in the process of this invention. Representative examples of such solvents are (a) the aliphatic ketones having from 3 to 6 carbon atoms, such as acetone, methylethylketone (MEK) and methylisobutyl ketone (MIBK), and mixtures of one or more of the aforesaid ketones with aromatics such as benzene, xylene and toluene. In addition, halogenated, low molecular weight hydrocarbons such as the $C_2$–$C_4$ chlorinated hydrocarbons, e.g., dichloromethane, dichloroethane, methylene chloride and mixtures thereof may be used as solvent either alone or in admixture with any of the aforementioned solvents. Another solvent that may be used in admixture with any of the other solvents is N-methyl-2-pyrrolidone (NMP). Specific examples of suitable solvents include mixtures of MEK and MIBK, MEK and toluene, dichloromethane and dichloroethane. Preferred solvents are ketones. Particularly preferred solvents include mixtures of MEK and MIBK and MEK and toluene.

In a preferred embodiment of this invention wherein the solvent system is a mixture of MEK and MIBK, the slurry will be dumped from the filter vat to a hot washings drum, wherein the hot solvent containing the dissolved wax from washing the fines from the filter cloth is combined with the slurry. In general, the ratio of the hot wash solvent to the dumped slurry will range from about 0.5 to 2.0 volumes per volume. The hot washings drum then contains a mixture of the slurry and hot solvent washings, said mixture typically being at a temperature ranging from about 40° to 80° F. and more preferably from about 45° to 60° F. At this temperature, the wax crystals present in the slurry that were dumped from the vat are partially dissolved and the mixture contains useful oil from the slurry which may amount to as much as one to two percent of the feed to the DILCHILL dewaxing or wax crystallizing zone, depending on the frequency and technique used in hot washing the fine wax crystals from the filter cloth. It has been found that if this mixture is recycled back into the DILCHILL wax crystallizing zone and injected at a point or points therein such that the temperature of the recycled mixture entering the tower is from 5° to 50° F. and more preferably from 20° to 30° F. lower than the bulk temperature of the oil or oil/solvent mixture into which the recycled mixture is injected, the partially dissolved crystals will again grow to a satisfactory size for good filtration under optimum conditions in the DILCHILL wax crystallizing zone, the valuable dewaxed oil is recovered, the solvent from both the dumped slurry and the hot washings is used as part of the DILCHILL dewaxing solvent rather than having to be redistilled in a wax recovery circuit and there is no decrease in the subsequent filter rate of the final dewaxed oil.

Any waxy petroleum oil stock or distillate fraction thereof may be dewaxed employing the improvement of this invention. Illustrative, but nonlimiting examples of such stocks are (a) distillate fractions that have a boiling range within the broad range of about 500° F. to about 1100° F. with preferred stocks including the lubricating oil and specialty oil fractions boiling within the range of between about 550° F. and 1050° F., (b) bright stocks and deasphalted resids having an initial boiling point above about 800° F. and (c) broad cut feed stocks that are produced by topping or distilling the lightest material off a crude leaving a broad cut oil, the major portion of which boils above about 500° F. or 650° F. Additionally, any of these feeds may be hydrocracked prior to distilling, dewaxing or topping. The distillate fractions may come from any source such as the paraffinic crudes obtained from Aramco, Kuwait, the Pan Handle, North Louisiana, etc., the heavier, slightly waxy fractions of naphthenic crudes, such as Tia Juana, Coastal crudes, etc., as well as the relatively heavy feed stocks, such as bright stocks having a boiling range of 1050+° F. and synthetic feed stocks derived from Athabasca Tar Sands, etc.

BRIEF DESCRIPTION OF THE DRAWING

The attached drawing is a flow diagram of a preferred embodiment of a process incorporating the improvement of this invention.

PREFERRED EMBODIMENT

Referring to the drawing in detail, a waxy lube oil feed above its cloud point at a temperature of about 130° F. is passed to the top of multi-staged DILCHILL wax crystallizing zone or tower 12 (hereinafter referred to as DILCHILL crystallizer) wherein it enters the first stage 14*a* of the crystallizer. DILCHILL crystallizer 12 contains 16 stages, each stage of which is provided with an agitator 16 mounted on a shaft 18 which is driven by variable speed motor 21. At the same time, cold dewaxing solvent, such as a 40/60 LV% (liquid volume percent) mixture of MEK/MIBK at a temperature of about −30° F. is fed into the various stages of crystallizer 12 via line 20, manifold 22 and multiple injection points 24. In each stage of crystallizer 12 into which the cold dewaxing solvent is fed the solvent is substantially instantaneously mixed with the waxy oil therein due to the mixing action of the impeller. The rate of solvent flow through each inlet or injection point is regulated by means (not shown) so as to maintain a desired temperature gradient along the length of crystallizer 12. Preferably, the rate of incremental solvent addition is such that the average chilling rate of the oil is below about 10° F./minute and most preferably between about 1° and 5° F./minute. By average chilling rate is meant dividing the total temperature drop along the crystallizer by the residence time of the waxy oil in the crystallizer. In general, the amount of solvent added thereto will be sufficient to provide a dewaxing solvent to waxy oil feed volume ratio ranging between about 2 and 4. Cooling of the oil continues to a temperature substantially below its cloud point, thereby precipitating at least a portion of the wax therefrom and forming a slurry comprising oil, solvent and crystals or particles of solid wax. This slurry reaches a temperature of about 15° F. in crystallizer 12 and is then fed to scraped surface chiller 28 via line 26 wherein it is additionally cooled down to a filtration temperature of 2° F. The cold slurry is then passed from scraped surface chiller 28 to a slurry vat (not shown) in rotary vacuum filter 32 via line 30 wherein the wax crystals are separated from the solvent-containing dewaxed oil filtrate. Wax and dewaxed oil are removed from filter 30 by separate means (not shown). Periodically, the flow of slurry to filter 32 via line 30 is interrupted, and the filtration is continued for a short time while the slurry level in the vat is lowered. The filtration is stopped before the slurry level gets below the bottom of the rotating drum, and slurry remaining in the filter vat is removed from filter 32 via line 36 and dumped into hot washings drum 38. Hot solvent at a temperature of 180° F. and comprising a mixture of MEK and MIBK enters filter 32 via line 34 and washes the fine wax particles from the filter cloth. The hot filter washings containing dissolved wax are passed from filter 32 to hot washings drum 38 via line 36 wherein they are mixed with the dumped slurry. Although the respective volumes and temperatures of the dumped slurry and hot solvent are such that the temperature of the mixture would be expected to be in the range of from about 90° to 125° F., it is actually much colder. This is because the hot solvent used for washing the filter contacts a large mass of cold metal in the internal piping and the filter vat. Thus, the actual temperature of the mixture of dumped slurry and hot washings is typically around 50° F. The heat transferred to the metal is later transferred to the filtrate when the normal filtration is resumed resulting in a slight temporary increase in filtrate temperature. The mixture from the hot washings drum 38, at a temperature of about 50° F. is then passed or recycled back into the fifth stage 14*e* of crystallizer 12 at a rate of about 0.04 volumes of mixture per volume of feed wherein it is instantaneously mixed with the slurry therein. The bulk temperature of the wax/oil/solvent slurry in stage 14*e* is about 85° F.

What is claimed is:

1. In a dewaxing process wherein a waxy hydrocarbon oil feed and solvent are introduced into a DILCHILL wax crystallizing zone to form a slurry comprising dewaxed oil, solvent and solid wax crystals and wherein said slurry is passed to a filter zone containing a filter surface for separating the solid wax from the dewaxed oil and solvent and wherein the slurry in said filter zone is periodically removed therefrom and mixed with solvent that was used to hot wash said filter surface, the improvement which comprises recycling from 0.02 to 0.4 volumes of said mixture back into said dewaxing zone per volume of oil feed entering said zone at one or more points in said zone wherein the temperature of said recycle mixture is from about 5° to 50° F. lower than the bulk temperature of the oil in said dewaxing zone.

2. The process of claim 1 wherein the hot wash solvent comprises the same solvent components used to cool the waxy oil in the DILCHILL wax crystallizing zone.

3. The process of claim 2 wherein the temperature of the recycled mixture ranges from about 40° to 80° F.

4. The process of claim 3 wherein the volumetric ratio of the hot wash solvent to the slurry dumped from the filter zone ranges from about 0.5 to 2.

5. The process of claim 4 wherein said waxy feed is a lube oil fraction.

6. The process of claim 1 wherein the temperature of the hot wash solvent ranges from about 140° to 180° F.

7. In a dewaxing process wherein a waxy lube oil feed is at least partially dewaxed in a DILCHILL wax crystallizing zone to form a slurry comprising dewaxed oil, solvent and particles of solid wax and wherein said slurry is passed from said dewaxing zone to a filter zone comprising a continuous rotary drum wax filter having a filter surface and wherein the slurry in said filter is periodically removed therefrom and the filter surface washed with hot solvent and wherein the hot solvent washings are mixed with the slurry removed from the filter, the improvement which comprises recycling from 0.02 to 0.4 volumes of said mixture back into said DILCHILL zone per volume of oil feed entering said zone at one or more points in said zone, wherein the temperature of said recycled mixture ranges from about 5 to about 50° F. lower than the bulk temperature of the slurry in said zone and wherein the amount of recycled mixture ranges from 0.02 to 0.4 volumes per volume of waxy oil feed entering said zone.

* * * * *